US005211495A

United States Patent [19]

Jozat et al.

[11] Patent Number: 5,211,495

[45] Date of Patent: May 18, 1993

[54] TUBULAR WRITING INSTRUMENT WITH SUCTION VENT

[75] Inventors: Walter Jozat, Bad Bramstedt; Steffen Wünsche, Hamburg; Ronald Broers, Hamburg; Thomas Hentze, Hamburg; Horst Eising, Hamburg, all of Fed. Rep. of Germany

[73] Assignee: rotring-werke Riepe KG, Hamburg, Fed. Rep. of Germany

[21] Appl. No.: 962,706

[22] Filed: Oct. 19, 1992

[30] Foreign Application Priority Data

Oct. 29, 1991 [DE] Fed. Rep. of Germany ..... 4135605

[51] Int. Cl.[5] ..... B43K 7/08; B43K 5/00

[52] U.S. Cl. ..... 401/217; 401/195; 401/224; 401/258; 401/276

[58] Field of Search ..... 401/217, 258, 276, 195, 401/224

[56] References Cited

U.S. PATENT DOCUMENTS 4,350,458 9/1982 Murahara et al. ..... 401/195 X
4,573,819 3/1986 Herrnring ..... 401/195 X

FOREIGN PATENT DOCUMENTS 3910787 9/1990 Fed. Rep. of Germany ..... 401/217

*Primary Examiner*—Steven A. Bratlie

[57] ABSTRACT

A writing or drawing instrument wherein a housing (1), is provided with a writing point (2) and a writing fluid reservoir (3) within an interior space of the housing. A capillary pressure equalization system (5), that connects the reservoir with the ambient air, has a sensor (7) therein for reacting to the level of writing fluid (4) therein. A suction pump (11, 12) is connected with the writing fluid reservoir (3) through a semi-permeable membrane (10) which lets air through and is impermeable for writing fluid (4). The suction pump (11, 12) is activated by the sensor (7) in response to a level of writing fluid (4) in the pressure equalization system, and aspirates air from the reservoir so as to quickly reduce an overpressure condition.

3 Claims, 1 Drawing Sheet

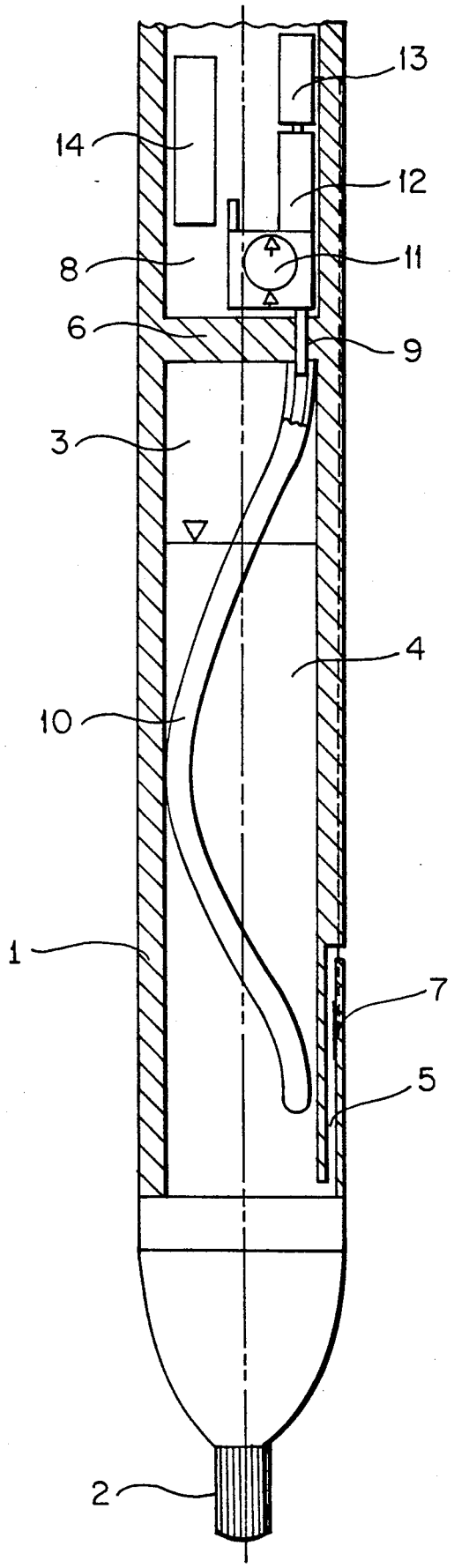
13
14
12
8
11
6
9
3
4
10
1
7
5
2

TUBULAR WRITING INSTRUMENT WITH SUCTION VENT

BACKGROUND OF THE INVENTION

1. Field of the Invention

The invention relates to a writing or drawing instrument with a housing, wherein a writing point is provided on the front, and, towards the rear, a writing fluid reservoir is provided in the housing interior. The reservoir is connected to ambient air via a capillary pressure equalization system.

2. Brief Description of the Prior Art

Writing and drawing instruments of this type typically are called tubular writing instruments. The writing point consists of a writing tube that is supplied with ink from an ink cartridge placed on a rear part of a housing which supports the writing tube. Pressure equalization is provided via a capillary pressure equalization chamber, one end of which is connected to the ambient air and the other to the interior of the housing containing ink. Hence, a partial vacuum, or underpressure, is not created in the ink reservoir when ink is expended, thus hampering a further output of ink by the writing tube. The pressure equalization chamber also receives ink if there should be overpressure in the ink reservoir. This factor is of particular importance in writing and drawing instruments of the type of interest here. An ink reservoir also contains air which expands, upon a rise in temperature, to a greater extent than the writing fluid so as to cause a considerable overpressure that will push a comparatively large amount of writing fluid into the pressure equalization chamber. As a result, writing fluid can exit through the end of the pressure equalization chamber connected to the ambient air, and lead to soiling.

OBJECTS AND SUMMARY OF THE INVENTION

It is an object of the invention to embody a tubular writing pen so that in response to a pressure increase in the writing fluid reservoir, the pressure equalization chamber will fill with writing fluid only up to a predetermined level.

This object is attained in accordance with the invention by a tubular writing pen embodied with a pressure equalization chamber having a sensor that reacts to writing fluid and a writing fluid reservoir that is connected with a suction pump via a semi-permeable membrane which lets air through, but is impermeable to writing fluid. When the sensor is acted upon by writing fluid, the sensor activates a suction pump.

A tubular writing pen according to the present invention preferably comprises a suction pump that is connected to a writing fluid reservoir through a semi-permeable membrane. When the suction pump is activated, air is aspirated from the writing fluid reservoir, while writing fluid cannot enter through the semi-permeable membrane. This aspiration of air results in rapid lowering of the pressure in the writing fluid reservoir, so that the overpressure being caused by a temperature increase, for example, is reduced in a very short time so that normal operating conditions can prevail again.

The sensor is positioned to react to an increased filling of the pressure equalization system caused by a build-up of overpressure and activate the suction pump. The suction pump aspirates air at least until the level of ink in the pressure equalization system has been sufficiently reduced, so that the sensor is no longer affected.

In a preferred embodiment of the invention the semi-permeable membrane is in the shape of a hose extending into the writing fluid reservoir, the free end of which is closed, while the other end is connected to a suction pump. The use of such a hose ensures that air not only is aspirated directly at the connection point between the suction pump and the writing fluid reservoir, but also from other areas within the writing fluid reservoir. This is particularly advantageous when the tubular writing pen is in a slightly inclined position, and writing fluid is present in a connecting area between the suction pump and the writing fluid reservoir, for example.

The end of the hose opposite the hose free end also preferably is seated on a pipe-shaped connector extending through a wall defining the writing fluid reservoir.

The invention will be described in detail below by means of a drawing figure schematically illustrating an exemplary embodiment.

BRIEF DESCRIPTION OF THE DRAWING

The single drawing figure is a schematic view in partial section of an embodiment of a tubular writing pen according to the present invention.

DETAILED DESCRIPTION OF THE PREFERRED EMBODIMENT

The tubular writing pen shown in partial section has a housing 1 in the shape of a holder shaft. A schematically shown writing tip 2, which may have the form of a writing tube, a fiber tip, a writing or drawing pen or the like, is disposed within a removable housing part on the front end of the tubular writing pen. The inner end of the writing tip 2 is connected in a conventional manner (not shown) with an interior chamber in the housing 1 that forms a writing fluid reservoir 3 containing a writing fluid 4, for example, a writing or drawing ink. A capillary pressure equalization chamber 5 customary for such writing instruments is provided in the wall of the housing 1 in the front area of the writing fluid reservoir 3. The capillary pressure equalization chamber has a front end connected to the writing fluid reservoir 3 and a back end connected to ambient air. A sensor 7 is disposed in an area which is closer to the back end of the pressure equalization chamber 5 than to its front end, and is constructed, for example, of a temperature-dependent resistor, a capacitive sensor, or the like.

The writing fluid reservoir 3 is closed off at the back end by a lateral wall 6, through which a pipe connection 9 extends. The housing 1 forms a further interior chamber 8 on the side of the lateral wall 6 facing away from the writing fluid reservoir 3, in which a suction pump 11 with a drive motor 12, an electronic circuit device 13 controlling the drive motor and a battery 14 supplying the motor are housed. The suction pump 11 has a maximum output of about 0.1 ml of air per minute. The circuit device 13 is connected to the sensor 7 via a connection indicated by dashed lines and the illustrated circuit evaluates a sensor signal in the customary manner.

A hose 10 has been placed on the connector 9 in the writing fluid reservoir 3, and has a closed end opposite to the end on the connector 9. The hose is made of a semi-permeable membrane through which air can enter, but which keeps fluid out. A hose of polytetrafluoroethylene, for example, having a pore size between 0.2 μm to 0.45 μm, is a suitable material for this characteristic. The hose may drape loosely as shown, or be formed as a spiral.

If there is a pressure increase in the writing fluid reservoir 3, for example because air present there expands considerably as a result of a rise in temperature, writing fluid 4 escapes into the pressure equalization chamber 5 until it reaches the area of the sensor 7. As fluid contacts the sensor 7, a signal is sent to the circuit device 13, which then activates the motor 12 of the aspirating pump 11. The aspirating pump 11 then aspirates air from the writing fluid reservoir 3 via the connector 9 and the hose 10 acting as the semi-permeable membrane. This aspiration results in a rapid decrease of the overpressure condition, and lowers the level of writing fluid in the pressure equalization chamber 5. After a prescribed time delay, the sensor 7 sends out a signal to the circuit device 13 indicating that the filling level in the pressure equalization chamber 5 has dropped, so that the operation of the aspirating pump 11 can be stopped.

It should be mentioned that any partial vacuum, or underpressure, condition occurring in the writing fluid reservoir 3 will be compensated for in the conventional manner by the pressure equalization chamber 5, and that function is not affected by the present invention.

While the present invention has been described with respect to what presently are considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

We claim:

1. In a writing or drawing instrument comprising a housing provided with a writing point and comprising a writing fluid reservoir within an interior space of the housing, wherein the reservoir is connected to ambient air via a capillary pressure equalization system, the improvement comprising a sensor (7) adapted to react to the presence of writing fluid (4) that is provided in a chamber of the capillary pressure equalization system (5), and a suction pump (11, 12) that is connected with the writing fluid reservoir (3) through a semipermeable membrane (10) which lets air through the membrane but is impermeable to writing fluid (4), wherein when the sensor (7) senses a certain level of writing fluid (4) in the capillary pressure equalization system, a signal is sent to a circuit means that activates the suction pump (11, 12) so as to reduce the level of writing fluid in the capillary pressure equalization system.

2. A writing or drawing instrument in accordance with claim 1, wherein the semi-permeable membrane is in the shape of a hose (10) that extends into the writing fluid reservoir (3), said hose having a free end that is closed, and an opposite end that is connected with the suction pump (11, 12).

3. A writing or drawing instrument in accordance with claim 2, wherein the opposite end of the hose (10) is seated on a pipe-shaped connector (9) which extends through a wall (6) defining the writing fluid reservoir (3).

* * * * *